US005335857A

United States Patent [19]

Hagon

[11] Patent Number: 5,335,857

[45] Date of Patent: Aug. 9, 1994

[54] SPRINKLER BREAKAGE, FLOODING AND THEFT PREVENTION MECHANISM

[75] Inventor: James W. Hagon, Salt Lake City, Utah

[73] Assignee: Sprinkler Sentry, Inc., Salt Lake City, Utah

[21] Appl. No.: 92,321

[22] Filed: Jul. 14, 1993

[51] Int. Cl.[5] ..... B05B 15/10

[52] U.S. Cl. ..... 239/204; 239/205; 239/207; 239/570; 137/68.1

[58] Field of Search ..... 239/200–206, 239/533.15, 570, 571, 207; 137/68.1, 71; 251/211

[56] References Cited

U.S. PATENT DOCUMENTS

| | | | |
|---|---|---|---|
| 3,684,179 | 8/1972 | Fischer et al. | 239/203 |
| 4,562,962 | 1/1986 | Hartman | 239/200 |
| 4,825,897 | 5/1989 | Shade | 239/571 |
| 4,848,661 | 7/1989 | Palmer et al. | 239/204 |
| 5,133,501 | 7/1992 | Marshall | 239/201 |
| 5,174,500 | 12/1992 | Yianilos | 239/201 |

*Primary Examiner*—Karen B. Merritt

*Attorney, Agent, or Firm*—Daniel P. McCarthy

[57] ABSTRACT

A flooding prevention device and a breakage prevention device for use with pressurized fluid systems are disclosed. The flooding prevention device includes a pipe with an interior passageway and a stopper located in the passageway, the stopper being adapted to seal the pipe whenever an accessory attached to the pipe is broken, thereby preventing fluid loss from the pressurized fluid system. The breakage prevention device includes a first pipe and a second pipe slidable within the first pipe, the sliding action accommodating pressure on or movement of components of the fluid system, thereby avoiding component breakage.

19 Claims, 6 Drawing Sheets

— PRIOR ART —

SPRINKLER BREAKAGE, FLOODING AND THEFT PREVENTION MECHANISM

BACKGROUND OF THE INVENTION

A. Field of the Invention

This invention relates generally to the field of lawn sprinklers, irrigation systems, and other systems for water or fluid distribution where parts breakage and/or fluid or pressure loss from the system could be problematic. More particularly, this invention relates to a device which compensates for movement of or impact on water pipes to prevent breakage, and a device which seals off a broken pipe to prevent leakage of any fluid contained therein. An incidental benefit of the invention when applied to lawn sprinklers is that it deters theft of expensive sprinkler heads.

B. The Background Art

In the prior art, substantial problems have been experienced with sprinkler breakage. Lawn sprinkler heads and sprinkler heads used for agricultural irrigation are typically made from brittle plastic and may be easily broken when driven over by an automobile or a lawn mower or even when stepped on. Breakage of a typical prior art sprinkler head results in the sprinkler system sending most of its volume of water through the broken head, flooding the area in that vicinity but leaving the rest of the area to be watered with little or no water. As a result, a great volume of water may be lost through the broken sprinkler head, resulting in damage to the ground in that area from excessive watering and depleting precious water resources in states which experience chronic water shortages. The prior art has demonstrated a need for a device which prevents sprinkler head breakage and a device which directs water flow away from a broken sprinkler head.

Another problem of the prior art is that water pooling around a sprinkler head during lawn watering will tend to drain back into the sprinkler system through the sprinkler head after lawn watering is complete. Such water draining back into the system will carry dirt, grass, stones and other debris with it into the sprinkler system. This dirt will accumulate in a sprinkler system over time clogging the system, including clogging pop-up sprinkler heads so that their pop-up members become stuck in their protruding position and are subject to breakage from vehicles, pedestrian traffic and lawn mowers.

Another problem in the prior art is that expensive sprinkler heads are frequently the target of thieves. In most applications, a sprinkler head may be quickly and easily unscrewed from the sprinkler system and removed. Because of this vulnerability, many parties are unwilling to invest in high quality sprinkler heads. The prior art showed a need for a device which makes removal (and hence theft) of sprinkler heads difficult. The invention provides a device which prevents sprinkler head removal absent digging into the ground beneath the sprinkler head. The additional effort required to remove a sprinkler head from such a device is expected to stop most sprinkler head theft.

An attempt of the prior art to solve the flooding problem of the prior art sprinkler devices is shown in U.S. Pat. No. 5,174,500 issued to Yianilos on Dec. 29, 1992 and is hereby incorporated by reference in its entirety. Yianilos is directed to a sprinkler head assembly that includes a bifurcated member with first and second leg portions and having a sealing means, the sprinkler head assembly being of the fixed or non-pop-up type and the bifurcated member disclosed being adapted specifically for use with such a sprinkler head. The device of Yianilos by its inherent nature would not work with pop-up sprinkler heads because the bifurcated member is not capable of being actuated by a pop-up member and because the device does not include adequate travel to function with a pop-up. Further, the device of Yianilos as described and illustrated functions only when the sprinkler head is completely removed. If the sprinkler head is broken but is not complete removed, the Yianilos device is inoperative and does not prevent sprinkler flooding. If an attempt were made to use the Yianilos device with a pop-up sprinkler head, the Yianilos device would be inoperative because breakage of the pop-up member would not bring about the desired sealing function and flooding would still result. Further, Yianilos does not provide any dual check valve function, a very important feature to prevent entry of dirt into the sprinkler system, sticking of pop-up sprinkler heads and their consequent breakage. The bifurcated member's design inherently prevents downward sealing and hence prevents any dual sealing function. For these reasons, Yianilos fails to solve or even directly address the problems solved by the present invention.

U.S. Pat. No. 5,133,501 issued to Marshall on Jul. 28, 1992, which is hereby incorporated by reference in its entirety, discloses an adjustable riser device for use in sprinkler systems. The device disclosed by Marshall may be selectively adjusted to a variety of fixed heights. The device of Marshall does not, however, remain underground or at ground level until water pressure is present. The device of Marshall is instead fixed in an upright position above the ground and is left in that position, subject to breakage. Further, Marshall provides no ability to move in compensation for force placed on the device to avoid breakage.

SUMMARY OF THE INVENTION

It is an object of the invention to provide a device which compensates for movement of or impact on sprinkler system components to prevent breakage of the fragile plastic components of the sprinkler system. This is accomplished by a breakage prevention device.

It is a further object of the invention to provide a device which directs pressurized water within a sprinkler system away from a broken component, preventing pressure loss in the system, ineffective watering or irrigation, and waste of water. This is accomplished by a flooding prevention device.

It is also an object of the invention to prevent sprinkler head removal absent digging into the ground beneath the sprinkler head, hence minimizing theft of sprinkler heads. This is achieved by the breakage prevention device.

It is a further object of the invention to prevent entry of water into a sprinkler system other than from the pressurized water source, thereby preventing clogging of pop-up sprinkler heads and consequent breakage. This is prevented by a flooding prevention device.

It is an object of the invention to provide a dual sealing function in a pop-up sprinkler head environment to seal off the pressurized water source when the pop-up member is broken and to prevent entry of water into the sprinkler system from the sprinkler head.

DESCRIPTION OF THE PREFERRED EMBODIMENTS

Figure 1A:
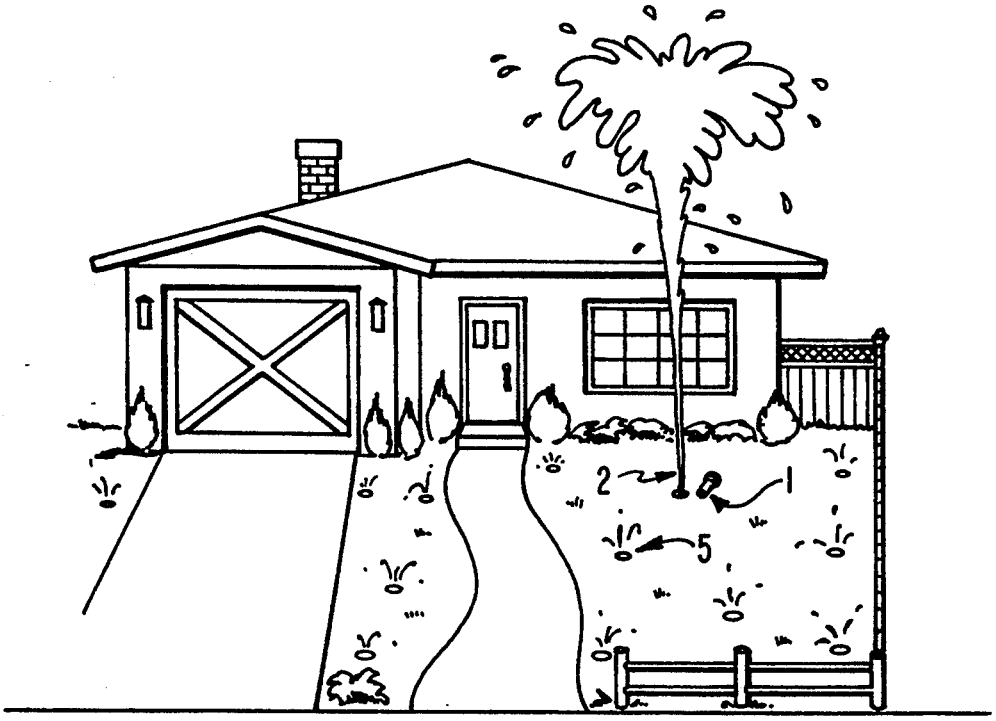
FIG. 1*a* depicts a prior art sprinkler system having one broken sprinkler head or pop-up member, suffering from water pressure loss throughout most of the system and flooding about the broken sprinkler head.

Referring to FIG. 1*a*, a prior art sprinkler system is illustrated. Such a system may suffer from a broken sprinkler head or pop-up member 1, causing flooding in the vicinity 2 of the broken head or pop-up member 1, and a general loss of water pressure and ineffective sprinkling throughout the rest of the system, such as at intact sprinkler head 5. This is a common scene during summer months throughout the country.

A sprinkler head or pop-up member may be broken for a variety of reasons, such as being run over by a lawn mower or automobile, being struck by a lawn mower blade, being stepped on, being struck by a snow plow during winter months, or due to vandalism. The brittle plastic of most prior art sprinkler heads lends itself to easy breakage. Pop-up sprinkler heads which are predominantly used for residential and commercial lawn watering are especially susceptible to breakage. Water pooling around sprinkler heads tends to drain back into the sprinkler system after the sprinkler system is shut off, bringing with it dirt, stones, grass and other debris. The dirt and other material then accumulates within the sprinkler system over time causing clogging and requiring labor-intensive flushing of the system. Additionally, the dirt and other material tend to clog the pop-up member of pop-up sprinkler heads in their extended position, making them especially susceptible to breakage from lawn mowers, pedestrians, automobiles, and other hazards. As a result, the design of prior art sprinkler heads which permits water to drain back into the sprinkler system leads to parts breakage.

Frequently, broken sprinkler heads are not discovered for hours or even days after breakage, resulting in long periods of time passing with the system in a malfunctioning state. During the periods of malfunction, the escape of an excess of water in the vicinity of a broken sprinkler head causes erosion of the soil and damage to plants in that area. Further, large quantities of water, a precious resource in most western states, are lost due to sprinkler head breakage. Finally, for the period of malfunction, the entire sprinkler system suffers from a general drop in water pressure and the rest of the lawn or other area being watered is not watered effectively. Thus, a repeat watering is typically required after repair of the broken head, resulting in a further waste of water.

Figure 1B:
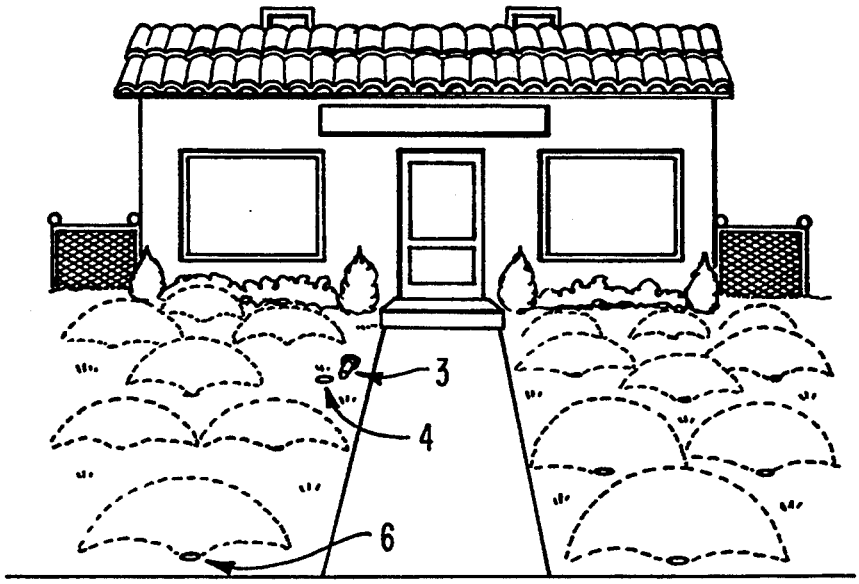
FIG. 1*b* depicts a sprinkler system with the invention deployed, the sprinkler system having one broken sprinkler head or pop-up member but suffering no loss of water pressure or flooding in any area.

FIG. 1*b* demonstrates how the present invention remedies the problem illustrated in FIG. 1*a*. A broken sprinkler head or pop-up member 3 is shown, but no flooding is occurring in the vicinity 4 of the broken head. Further, the rest of the sprinkler system is fully pressurized and continues to water the lawn in the proper manner, typified by the performance of sprinkler head 6. No loss of water pressure or flooding in is found in any area of the lawn being watered, so no water is wasted and no re-watering is required after repair of the broken sprinkler head.

Figure 2A:
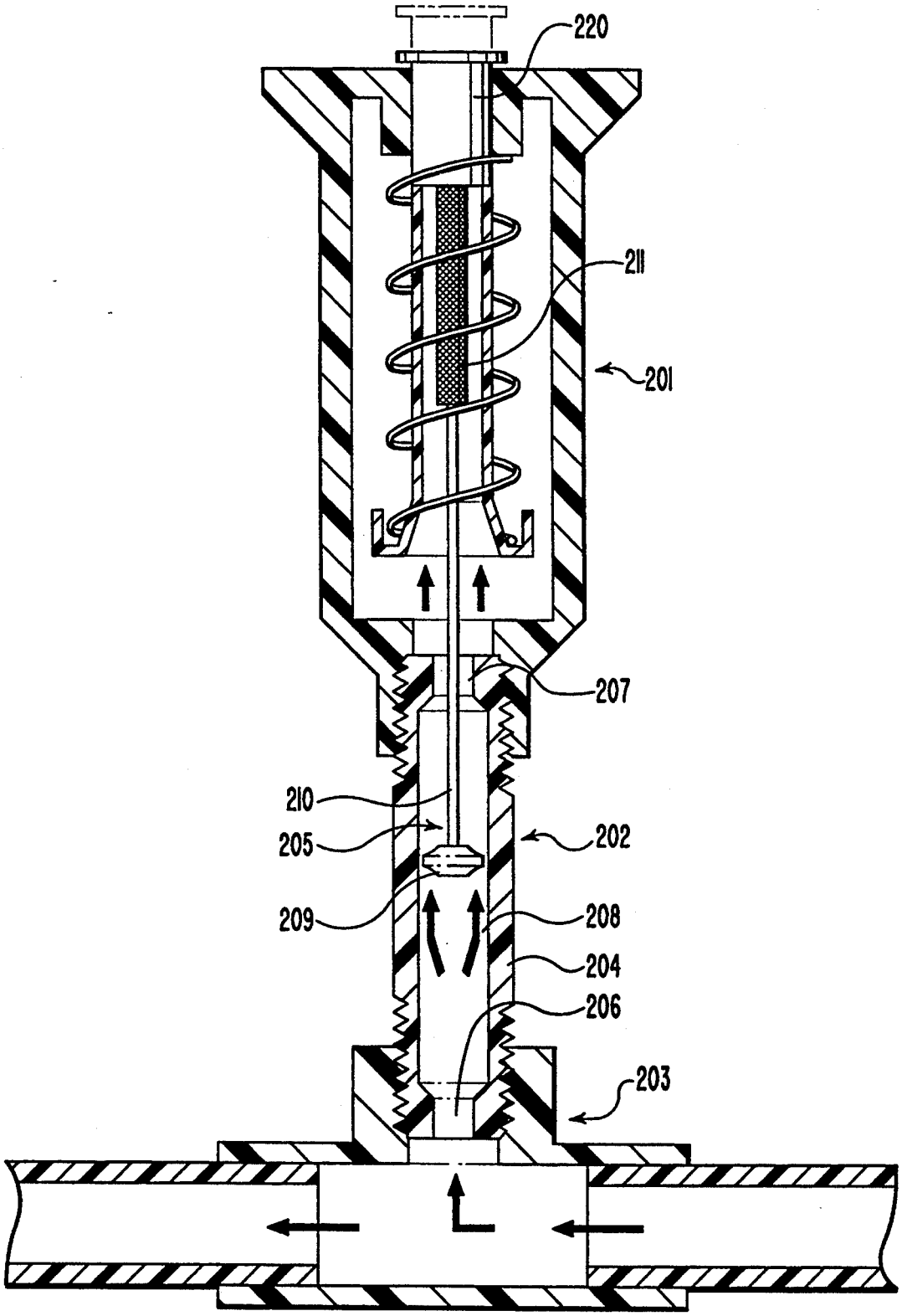
FIG. 2*a* depicts the flooding prevention device of the invention in use in conjunction with an operational prior art pop-up sprinkler head.

FIG. 2*a* depicts the flooding prevention device of the invention in use in conjunction with an operational prior art pop-up sprinkler head. Shown is a prior art pop-up sprinkler head 201 mounted to the flooding prevention device 202 of the present invention, the flooding prevention device 202 in turn being mountable to a pressurized water source 203 such as a sprinkler system or irrigation system. The major components of the flooding prevention device are a pipe 204, conduit or other means for conducting fluid or water from a pressurized source to another device such as a sprinkler head, and a stopper 205. The pipe 204 of the preferred embodiment has a constricted water entry orifice 206 and a constricted water exit orifice 207 to retain stopper 205 within its interior. The interior of the pipe 204 has a hollow passageway 208 which permits longitudinal sliding of the stopper 205 between constricted orifices 206 and 207. The stopper 205 includes a seal member 209 mounted to one end of a rigid rod 210.

In use, water enters the pipe 204 thorough the entry orifice 206, flows through passageway 208, past seal 209, through exit orifice 207 and into sprinkler head 201. Movement of water through the flooding prevention device 202 is substantially unrestricted because the sprinkler head 201 is not broken so stopper 205 is not engaged. Rod 210 of the stopper 205 is pushed against an extension portion 211 of the pop-up member 220 by water pressure, thus preventing seal 209 from mating with the rim of exit orifice 207 and forming a watertight seal therewith.

Figure 2B:
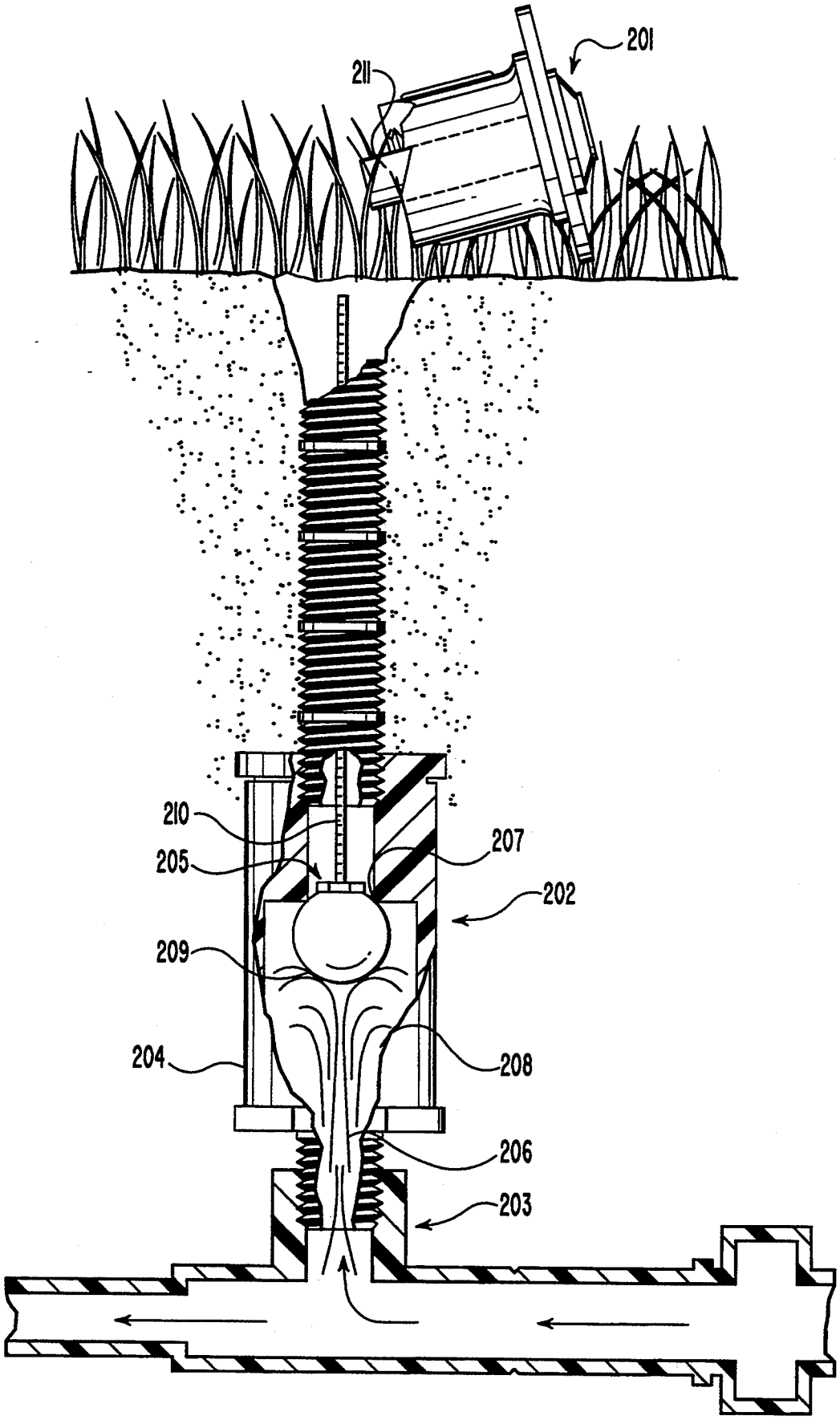
FIG. 2*b* depicts the flooding prevention device of the invention in use in conjunction with a broken prior art sprinkler head, serving to seal the water passage leading to the broken component and maintaining water pressure within the system.

FIG. 2*b* depicts the flooding prevention device of the invention in use in conjunction with a broken prior art sprinkler head, serving to seal the water passage leading to the broken component and maintaining water pressure within the system. As shown in the figure, the sprinkler head 201 has been completely broken off. The embodiment shown in FIG. 2*b* is a minor variation of the embodiment shown in FIG. 2*a*. In FIG. 2*b*, water from the pressurized water source moves through the entry orifice 206, into passageway 208 of pipe 204, and forces seal 209 of stopper 205 against exit orifice 207, forming a substantially fluid-tight seal therewith and preventing loss of water or flooding due to broken head 201. The seal 209 may move into contact with exit orifice 207 because the breaking of head 201 moves the portion 211 of the head that served as a stop for rod 210, permitting pressurized water to carry the stopper 205 upward for sealing. Alternatively or in conjunction with these events, rod 210 may be broken, resulting in the seal 209 moving into position to seal off the exit orifice 207. A very brittle rod 210 is used in the preferred embodiment to facilitate such rod breakage and hence sealing. The seal 209 is depicted in the figure as a rubber ball seal, although the invention requires only that it be of a shape and of a material capable of forming a substantially water-tight seal with the exit orifice. Such materials include rubber, plastic, silicone, metal and others. Almost any shape seal could be used if it had the ability to mate with the exit orifice in a sealing fashion.

Although the breakage shown in FIG. 2*b* is severe, the invention also serves to prevent flooding when a less drastic break takes place. It is very common for the pop-up member 220 of a sprinkler to become stuck in its extended position (such as from dirt clogging) and be broken of by the lawn mower or another hazard. If that occurs, the pop-up member extension 211 will either be removed from the sprinkler head 201 by the breakage or will be deviated from the rod 210, permitting the rod 210 to move upward and form a seal at exit orifice 207. Thus, although the breakage was not severe, only a pop-up member 220 having been broken, the invention still forms a seal and prevents flooding.

Another feature provided by the flooding prevention device is a second sealing function to prevent entry of water and its concomitant dirt and debris into the sprinkler system from other than the pressurized water source. When the sprinkler system is turned off and water pressure drops, the rod 210 and its stopper 209 will be pulled by gravity so that stopper 209 rests on the inner rim of entry orifice 206. The stopper 209 will form a seal with the entry orifice 206, preventing water which may enter the sprinkler head 201 from traveling past the stopper 209 into the sprinkler system. This sealing function combined with the previously described breakage sealing function give the invention a dual sealing or dual check valve characteristic.

The invention also serves as an extension piece between a water system 203 and a sprinkler head 201. In prior art sprinkler systems, an extension piece or pipe of some type is needed to connect sprinkler head 201 with water system 203. The invention serves as such an extension piece and provides the dual check valve characteristic.

The pipe 204 is considered a means for conducting pressurized fluid from a source (203) to a destination (201), and the pipe has an exterior substantially fluid-tight body (such as polyvinyl chloride pipe). The rod 210 is considered a positioning means because it positions the seal 209 away from exit orifice 207 until sprinkler head 201 is broken and there is a need for the sealing function of the invention. In some embodiments of the invention, rod 210 and seal 209 form an integral unit, such as when they are made as a single injection molded plastic piece.

The invention is compatible with many known prior art water systems 203. The invention is compatible with various prior art sprinkler heads as well. In various other embodiments, the invention could be used with any pressurized fluid or pressurized gas system. The pipe used in the invention and in conjunction therewith is standard polyvinyl chloride (PVC) pipe, but almost any pipe could be used, such as steel, lead, copper, plastic, or other pipe or tubing including tubing which is round, square or shaped otherwise in cross section. In the preferred embodiment, rod 210 is any rigid rod capable of supporting a seal 209 under water pressure typical of sprinkler systems and irrigation systems. Preferably rod 210 will be formed of a brittle plastic to encourage breakage of the rod and sealing any time the sprinkler head 201 is deviated from its normal position with respect to the longitudinal axis of pipe 204. Seal 209 is typically rubber or other sealing material. In some embodiments, entry orifice 206 may not be a constrained orifice. Passageway 208 must be sufficient to permit sliding movement of seal 209 and rod 210 within it without substantially impeding water flow through the passageway 208 until seal 209 mates and seals with exit orifice 207.

The embodiment of the invention shown in FIG. 2*a* serves as a dual check valve and may have application in various fluid or gas pipeline systems. Stopper 205 will act to seal the passageway 208 at exit orifice 207 when sprinkler head 201 or rod 210 is broken. The stopper 205 will also serve, however, to seal entry orifice 206 any time water flows from the sprinkler head 201 toward the entry orifice 206, regardless of parts breakage. These two sealing functions are referred to as the dual check valve feature of the invention. This second sealing function is very important because in the prior art when a sprinkler head breaks, water flooding around the head creates a puddle and erodes the soil. When the flooding water is shut off, a portion of the puddle drains into the sprinkler system at the point of breakage, carrying with it dirt, gravel and other debris. This dirt, gravel and other debris then circulates through the sprinkler system and clogs various sprinkler heads, requiring labor-intensive flushing of the entire sprinkler system and costly down time. The dual check valve function of the invention prevents water or other fluid from travelling the wrong way through a broken part into the fluid system and eliminates contamination of the system as a result of parts breakage. The dual check valve function of the invention would be very useful in fluid systems where one-way fluid travel is a requisite. Such a feature is especially important in lawn sprinkling systems where contamination is a chronic problem, but it also has application in other fluid systems. For example, in intravenous fluid delivery systems in medical applications it is desirable to deliver fluid from a fluid vessel through tubing, through a hypodermic needle and into a vein of the human body. It is undesirable, however, for blood to travel from the vein, through the hypodermic needle, through tubing and into the pressure vessel. The invention would assure the desired one-way fluid travel. Similarly, in pumping crude oil from underground wells, it is desirable for the crude oil to travel from beneath the ground through pipes to the ground surface. It is undesirable, however, for oil to drain back down pipes from the ground surface to the oil field beneath the ground. The invention would assure such one-way fluid travel.

Figure 3A:
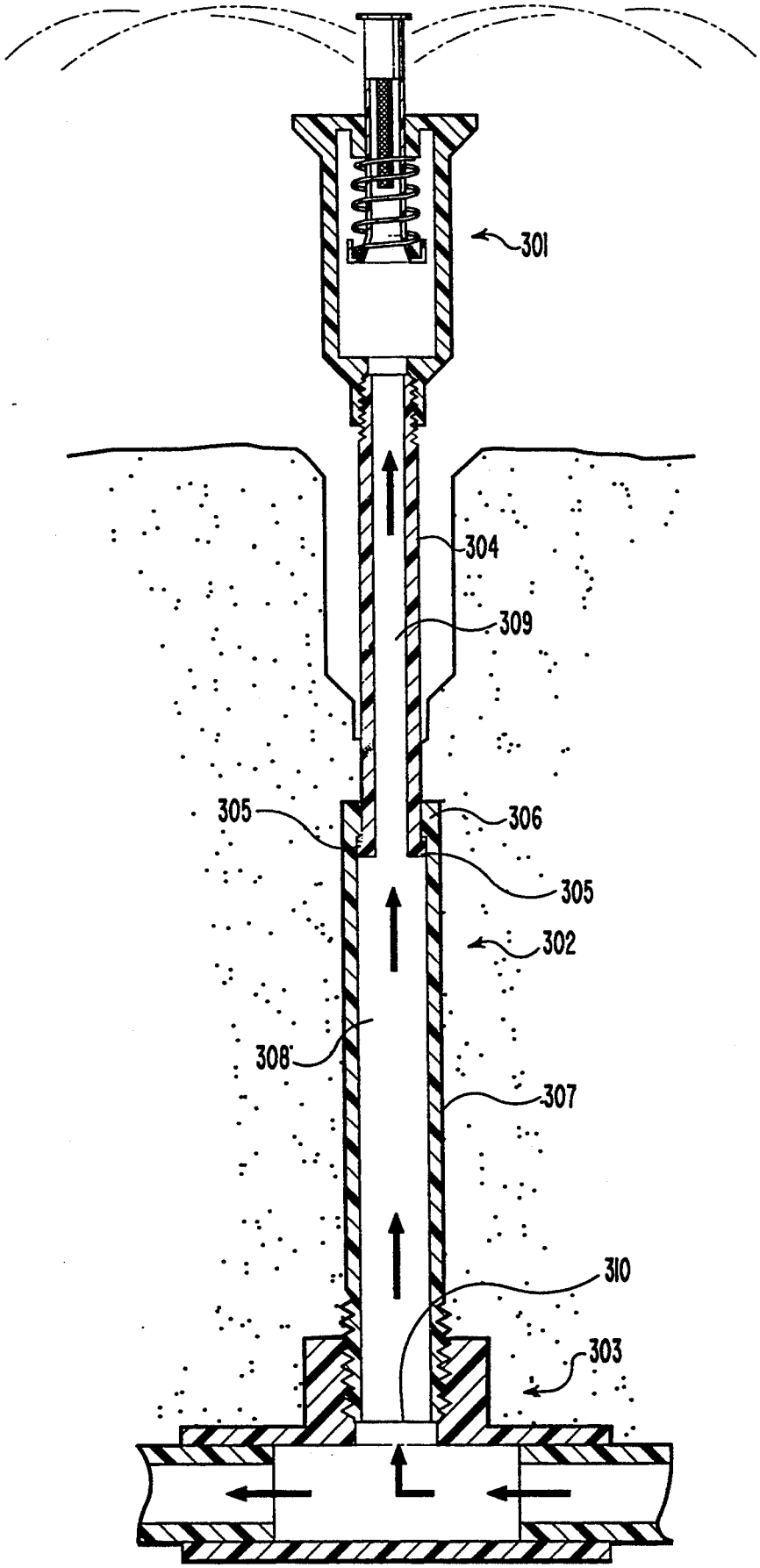
FIG. 3*a* depicts the breakage and theft prevention device of the invention in use in convention with an operational prior art sprinkler head.

FIG. 3*a* depicts the breakage and theft prevention device of the invention in use in convention with an operational prior art sprinkler head. Shown are a sprinkler head 301 attached to a breakage prevention device 302 in turn mounted to a fluid source 303. The breakage prevention device 302 includes a first body 307 such as a pipe mounted to a fluid source 303 such as a sprinkler system. The first body 307 includes a hollow passageway 308 within its interior, a substantially unrestricted entry orifice 310, and a constrained exit orifice 306. Telescopingly slidable within passageway 308 is found a second body 304 such as a pipe. Second body 304 has a hollow passageway 309 within its interior and a circumferential rim, skirt or lip 305 at one end of its length, the rim 305 being slidable within passageway 308 and engageable with constrained orifice 306 in substantially fluid-tight engagement therewith. Constrained orifice 306 is adapted to prevent the movement of rim 305 beyond orifice 306 thereby permitting second body 304 to project outwardly from first body 307 but not to completely separate therefrom.

In use on a sprinkler system, pressurized water moves from the system 303, through entry orifice 310, through passageway 308 exerting pressure on rim 305 and carrying second body 304 into a telescoping position with rim 305 in contact with exit orifice 306. The water moves into the passageway 309 of the second body 304, through the sprinkler head 301 and onto the lawn or area to be watered.

Figure 3B:
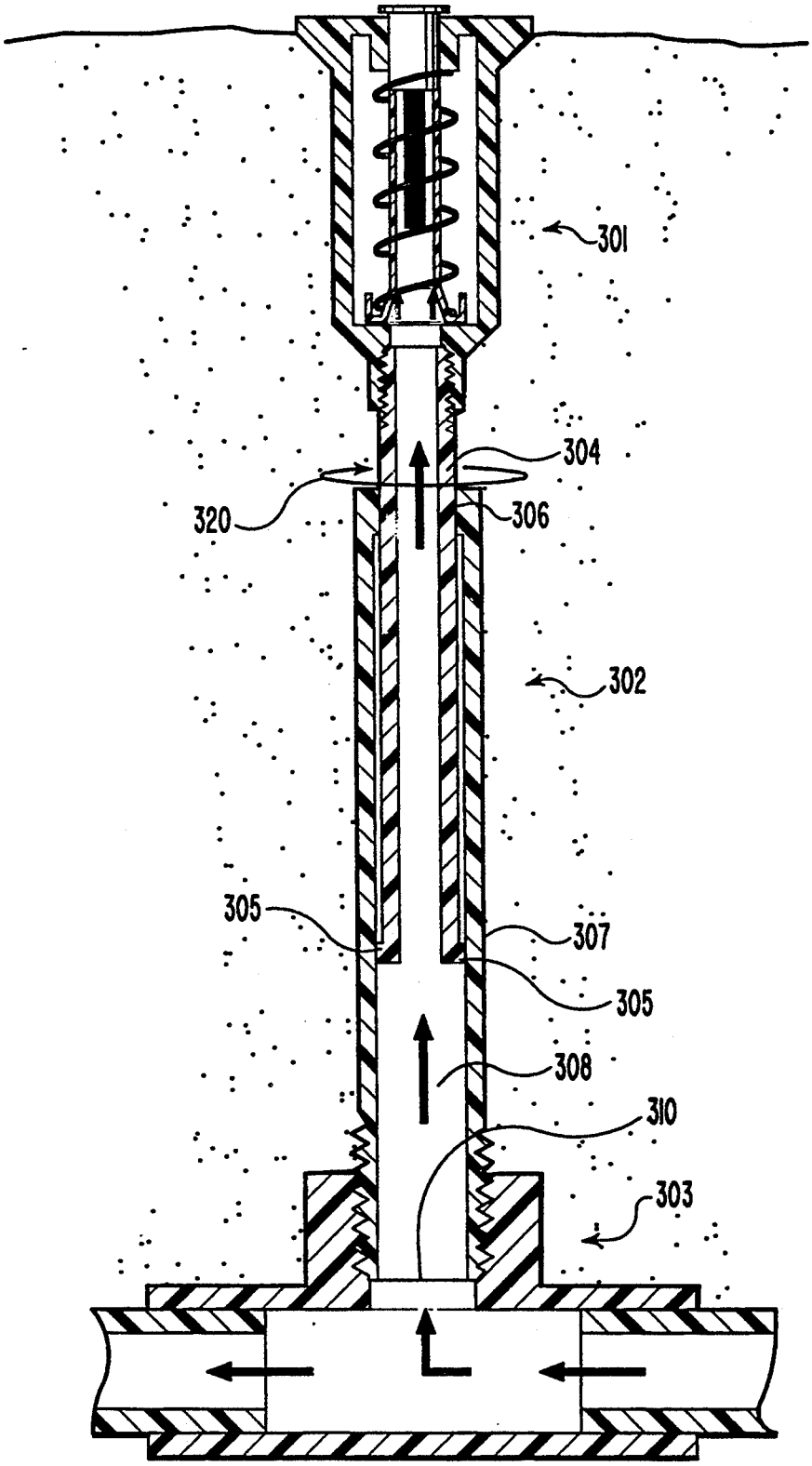
FIG. 3*b* depicts the breakage and theft prevention device of the invention in retracted position in use with a prior art sprinkler head.

FIG. 3*b* depicts the breakage and theft prevention device of the invention in retracted position in use with a prior art sprinkler head. When the invention is in use, an automobile or lawn mower may drive over the sprinkler head 301 causing the invention 302 to telescopingly retract and accommodate and compensate for the force applied against sprinkler head 301 with such telescoping movement, permitting sprinkler head 301 to be pressed into the ground and prevent breakage. Releasing water pressure into the system 303 will cause an outwardly telescoping movement of second body 304 within first body 307, moving the entire apparatus back into the position shown in FIG. 3*a*. In this manner, breakage of the sprinkler head or other components is prevented.

The problem of sprinkler heads being broken of by a snow plow can be eliminated merely by stepping on sprinkler heads 301 in the autumn after the last watering, pressing them all into the ground and out of reach of the snow plow.

The breakage prevention device also serves as theft prevention device because any attempt to unscrew sprinkler head 301 will result in second body 309 rotating freely with respect to first body 307 as depicted by arrow 320 in FIG. 3*b*, but will not result in removal of sprinkler head 301. In order to remove sprinkler head 301, some portion of ground about second body 304 must be dug away and second body 304 gripped tightly before unscrewing sprinkler head 301 is attempted. This additional effort required to remove sprinkler head 301 is expected to curtail most sprinkler head thefts.

The first body 307 and the second body 304 each comprise a substantially fluid-tight outer shell as shown in the figures, they share a common longitudinal axis in most embodiments of the invention, and in some embodiments of the invention, the first body and the second body are infinitely rotatable about their shared longitudinal axis in opposite directions with respect to each other, or either body may be held stationary while the other body is rotated.

The breakage prevention feature of the invention depicted in FIGS. 3*a* and 3*b* has another advantage as well. In the prior art, when installing sprinkler heads on a sprinkler system, some type of pipe extenders were used to connect sprinkler heads to the pressurized water supply. These extenders had to be accurately chosen or the sprinkler head would be too close to the ground and not water effectively or be too high off of the ground and be subject to breakage from lawn mowers and pedestrians. The breakage prevention feature of the invention eliminates the need to use accurately selected extenders because its telescoping function described above permits it to sit below ground level when not in use, avoiding harm from lawn mowers and pedestrians, yet when the sprinkler system is turned on, the telescoping feature will raise the sprinkler head several inches so that it will be well clear of ground level and water the area effectively.

Figure 4:
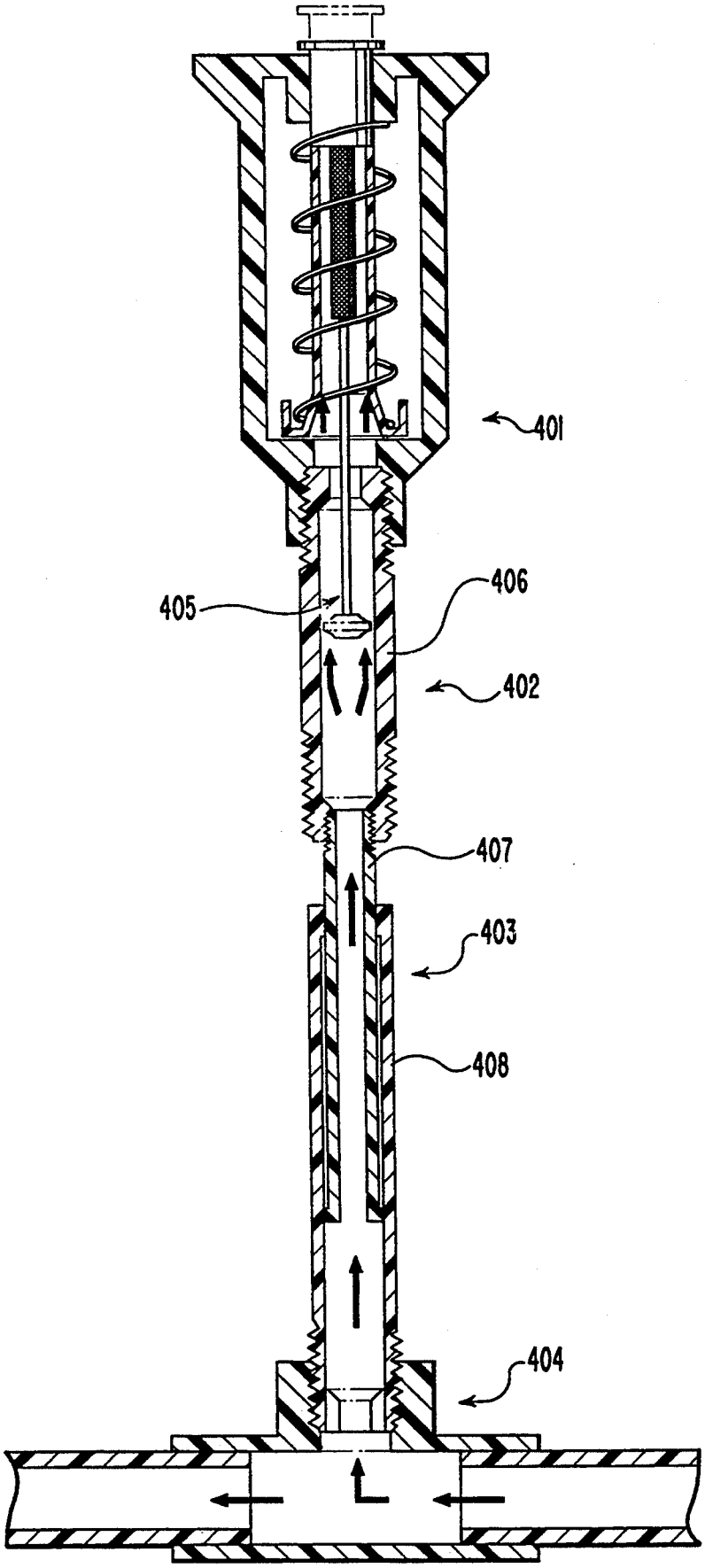
FIG. 4 depicts the flooding prevention and the breakage prevention devices of the invention in use together with a prior art sprinkler head.

FIG. 4 depicts the flooding prevention and the breakage and the theft prevention devices of the invention in use together with a prior art sprinkler head. Shown is sprinkler head 401 mounted to flooding prevention device 402 including stopper 405 and pipe 406, the flooding pretention device 402 in turn being mounted to breakage pretention device 403 including first body 408 and second body 407, the entire apparatus being mounted to a fluid source such as a sprinkler system 404.

This embodiment of the invention, including flooding prevention device and breakage prevention device, achieves the advantages of breakage prevention, theft prevention, and in the unlikely event of breakage, flooding prevention. This embodiment is particularly useful in instances where lawn mower blades are likely to create a nick or small crack in sprinkler head 401 causing water pressure loss and flooding but causing insufficient deviation of head 401 to bread the rod of the stopper 405 and effect a sealing action. Pressure on the sprinkler head 40 would tend to drive it down into the ground and out of reach of lawn mower blades or other dangers, but in the event such pressure causes breakage of sprinkler head 401, the flooding prevention device 402 would activate to prevent water loss from the system.

Both the breakage prevention deice and the flooding prevention device features of the invention have application in residential and commercial lawn, shrub, flower and tree watering systems. They are also useful in agricultural irrigation systems which may utilize the same principles of lawn watering but with different delivery methods and on a larger scale. In agricultural applications, the flooding prevention feature and breakage prevention feature of the invention are needed as much as they are in the residential and commercial lawn watering context. They are also useful on agricultural irrigation systems which utilize many of the same principles of lawn watering but with different delivery methods and on a larger scale. In agricultural applications, the flooding prevention device and breakage prevention features are needed as much as they are in the lawn watering context. Further the breakage prevention device and flooding prevention features of the invention are useful in any fluid system where parts breakage or fluid leaks are considered problematic and would work according to the same principles described above. The invention could be used in very small systems such as intravenous applications in the medical field, in large systems such as urban culinary water systems or in any other fluid or gas transmission or delivery system.

While the present invention has been described and illustrated in conjunction with a number of specific embodiments, those skilled in the art will appreciate that variations and modifications may be made without departing from the principles of the invention as herein illustrated, described and claimed. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A device for breakage and flooding prevention for use on a watering system incorporating a pop-up sprinkler head, the device comprising:

a flooding prevention device comprising:

means for conducting pressurized fluid from a source to a destination, said conducting means having an interior fluid passageway and an exterior substantially fluid-tight body, said body including a constrained entry orifice for receiving fluid into said conducting means passageway and a constrained exit orifice at the opposite end of said conducting means passageway, and a stopper locatable within said conducting means passageway, said stopper including a positioning means and a sealing means attachable to said positioning means, said stopper being slidable within said conducting means passageway, said sealing means being. adapted to form a substantially fluid-tight seal with said conducting means constrained entry orifice and said constrained exit orifice, said positioning means being extendable from within said conducting means to the exterior of said conducting means through said conducting means exit orifice, said positioning means being adapted for resting against a pop-up sprinkler head when water flows from said source to said destination, and a breakage prevention device comprising:

a first body comprising a substantially fluid-tight outer shell, a first body hollow passageway within the interior of said first body, said first body hollow passageway being adapted to conduct a fluid the length of said first body, and a constrained exit orifice, and a second body comprising a substantially fluid-tight outer shell, a second body hollow passageway within the interior of said second body, said second body hollow passageway being adapted to conduct a fluid the length of said second body, and a rim about one end of said second body, said second body being adapted to be slidable within said first body passageway, and said first body constrained exit orifice being adapted to permit said second body to extend from the interior of said first body to the exterior of said first body through said constrained exit orifice;

wherein each of said breakage prevention device and said flooding prevention device includes means for establishing a substantially fluid-tight engagement with each other.

2. A device as recited in claim 1 wherein said first body constrained exit orifice and said second body rim include means for establishing a substantially fluid-tight seal with each other and wherein said first body and second body share a longitudinal axis and wherein said first body and said second body are infinitely rotatable with respect to each other about said longitudinal axis.

3. A device as recited in claim 2 wherein said rim of said second body is adapted to receive fluid pressure upon its surface, causing said second body to slide within said first body passageway, resulting in said second body rim contacting said first body constrained exit orifice and resulting in said second body protruding from said first body through said first body exit orifice.

4. A flooding prevention device for use in a sprinkler system in conjunction with a pop-up sprinkler head comprising:

means for conducting pressurized water from a pressurized water source to a pop-up sprinkler head, said conducting means having an interior fluid passageway and an exterior substantially fluid-tight body, said body including a constrained entry orifice for receiving fluid into said passageway and a constrained exit orifice at the opposite end of said passageway, and a stopper locatable within said passageway, said stopper including a positioning means and a sealing means attachable to said positioning means, said positioning means being adapted to be forced against a pop-up member of a pop-up sprinkler head exclusively by hydraulic pressure when pressurized water is flowing through said conducting means;

wherein said stopper is slidable within said passageway between said entry orifice and said exit orifice;

wherein said sealing means is adapted to form a substantially fluid-tight seal with said constrained entry orifice and with said constrained exit orifice to achieve a dual check valve function; and wherein said positioning means may extend from within said conducting means to the exterior of said conducting means through said exit orifice.

5. A device as recited in claim 4 wherein said dual check valve function is capable of substantially preventing entry of water-borne debris into said water source from said sprinkler head by contacting and sealing said sealing means of said stopper with said constrained entry orifice at times when said conducting means is not conducting pressurized water from said pressurized water source to said sprinkler head.

6. A device as recited in claim 4 wherein the combination of said stopper and constrained entry orifice are adapted to permit fluid flow through said flooding prevention device in substantially one direction only.

7. A device as recited in claim 4 wherein said positioning means is a brittle plastic rod.

8. A device as recited in claim 7 wherein said sealing means includes material selected from the group consisting of rubber, plastic, silicone and metal.

9. A device as recited in claim 4 wherein said stopper is a one-piece stopper and said positioning means and said sealing means are integral to each other.

10. A device as recited in claim 4 wherein said flooding prevention device includes means for installation on agricultural watering systems.

11. A device as recited in claim 4 wherein said flooding prevention device includes mean for installation on lawn watering systems.

12. A breakage prevention device comprising:

a first body comprising a substantially fluid-tight outer shell, a first body hollow passageway within the interior of said first body, said first body hollow passageway being adapted to conduct a fluid the length of said first body, and a constrained exit orifice, and a second body comprising a substantially fluid-tight outer shell, a second body hollow passageway within the interior of said second body, said second body hollow passageway being adapted to conduct a fluid the length of said second body, and a rim about one end of said second body;

wherein said second body is adapted to be slidable within said first body passageway;

wherein said first body constrained exit orifice adapted to permit said second body to extend from the interior of said first body to the exterior of said first body through said constrained exit orifice; and wherein said second body caused to extend from the interior of said first body to the exterior of said first body through said constrained exit orifice by hydraulic pressure exerted against said second body rim by a fluid being conducted through the breakage prevention device.

13. A device as recited in claim 12 wherein said first body constrained exit orifice and said second body rim include means for establishing a substantially fluid-tight seal.

14. A device as recited in claim 12 wherein said first body includes means for mounting on a pressurized fluid source.

15. A device as recited in claim 14 wherein said first body includes means for mounting on a fluid destination.

16. A device as recited in claim 12 wherein said first body and second body share a longitudinal axis and wherein said first body and said second body are infinitely rotatable with respect to each other about said longitudinal axis.

17. A device as recited in claim 12 wherein said rim of said second body is adapted to have fluid pressure exerted upon its surface, causing said second body to slide within said first body passageway, resulting in said rim contacting said constrained exit orifice and resulting in said second body protruding from said first body through said exit orifice.

18. A device as recited in claim 17 wherein said first body and said second body are constructed from polyvinyl chloride.

19. A device as recited in claim 17 wherein said first body and said second body share a longitudinal axis and wherein said first body and said second body are infinitely rotatable with respect to each other about said longitudinal axis and wherein said first body constrained exit orifice and said second body rim include means for establishing a substantially fluid-tight seal.

* * * * *